US007384689B2

(12) United States Patent
Mikus

(10) Patent No.: US 7,384,689 B2
(45) Date of Patent: Jun. 10, 2008

(54) CEMENTED CARBIDE BODY

(75) Inventor: Marian Mikus, Skärholmen (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 11/527,530

(22) Filed: Sep. 27, 2006

(65) Prior Publication Data

US 2007/0020477 A1 Jan. 25, 2007

Related U.S. Application Data

(63) Continuation of application No. 10/432,436, filed as application No. PCT/SE01/02600 on Nov. 23, 2001, now Pat. No. 7,150,897.

(30) Foreign Application Priority Data

Nov. 23, 2000 (SE) ..... 0004290

(51) Int. Cl.
*B23B 27/14* (2006.01)

(52) U.S. Cl. ..... 428/325; 75/240; 75/242; 75/243; 428/212; 428/698

(58) Field of Classification Search ..... 75/240, 75/242, 243; 428/698, 212, 325; 51/307, 51/309

See application file for complete search history.

(56) References Cited

U.S. PATENT DOCUMENTS

| | | | | |
|---|---|---|---|---|
| 4,820,482 | A * | 4/1989 | Fischer et al. | 75/242 |
| 4,830,886 | A | 5/1989 | Cho et al. | |
| 4,830,930 | A | 5/1989 | Taniguchi et al. | |
| 4,843,039 | A * | 6/1989 | Akesson et al. | 428/698 |
| 5,286,549 | A * | 2/1994 | Hartzell et al. | 428/547 |
| 5,619,000 | A * | 4/1997 | Ederyd et al. | 75/240 |
| 5,665,431 | A | 9/1997 | Narasimhan | |
| 5,729,823 | A * | 3/1998 | Gustafson et al. | 51/307 |
| 5,856,626 | A * | 1/1999 | Fischer et al. | 75/242 |
| 6,299,992 | B1 * | 10/2001 | Lindskog et al. | 428/698 |
| 6,436,204 | B1 | 8/2002 | Gates et al. | |
| 6,447,912 | B1 | 9/2002 | Mikus et al. | |

FOREIGN PATENT DOCUMENTS

| | | |
|---|---|---|
| EP | 0 560 212 | 9/1993 |
| WO | 98/35071 | 8/1998 |
| WO | 99/31292 | 6/1999 |
| WO | 00/31314 | 6/2000 |

OTHER PUBLICATIONS

Schwarzkopf et al., "Kinetics of Compositional Modification of (W,Ti)C-WC-Co Alloy Surfaces", Materials Science and Engineering, *Elsevier Sequoia*, (1998), pp. 225-231.

* cited by examiner

*Primary Examiner*—A. A. Turner
(74) *Attorney, Agent, or Firm*—Drinker Biddle & Reath LLP

(57) ABSTRACT

According to the present invention there is now provided a body cemented carbide provided with at least one wear resistant layer, which body contains a toughness increasing surface zone. Increase in toughness is obtained due to the presence of a surface zone having increased WC grain size and/or increased Co content. The invention is most suitable for WC—Co cemented carbides.

28 Claims, 5 Drawing Sheets

CEMENTED CARBIDE BODY

This is a continuation application of application Ser. No. 10/432,436, filed on Dec. 8, 2003, now U.S. Pat. No. 7,150,897, which is a national stage filing based on PCT International Application No. PCT/SE01/02600, filed on Nov. 23, 2001 which claims the priority of application no. SE 0004290-3, filed in Sweden on Nov. 23, 2000, each of these prior applications are incorporated by reference herein in their entireties.

BACKGROUND OF THE INVENTION

The present invention relates to coated cemented carbide cutting tools with improved properties obtained by a heat treatment of the cemented carbide before the application of a wear resistant coating. The invention is, in particular, applicable to WC+Co based cemented carbide but can also be applied to cemented carbide of WC+Co+gamma phase (gamma phase is a common name for solid solution carbide, mainly comprising W as well as Ti, Ta and Nb).

A common method for achieving an improvement in toughness of coated cemented carbide cutting tool inserts is by various types of gradient sintering methods in which Co enriched surface zones are formed, Two major methods are used.

In one method, an addition of nitrogen in the form of TiN or Ti(C,N) to WC—Co-gamma phase grades is used, which during sintering develops a Co— enriched surface zone free from gamma phase with a thickness of up to 30 μm.

In the other method, a controlled slow rate of cooling down from the sintering temperature is used, whereby a Co-enriched surface zone having Co in the form of a stratified structure is formed. This is achieved in WC—Co-gamma phase or WC—Co based cemented carbide having a carbon content over the carbon saturation point and thus containing free graphite.

U.S. Pat. No. 4,830,930 discloses a surface refined sintered alloy body which comprises a hard phase and a binder phase. The concentration of the binder phase in the surface layer is highest at the outermost surface thereof and approaches the concentration of the inner portion, the concentration of the binder phase decreasing from the outermost surface to a point at least 5 μm from the surface. The method for making the same includes applying a decarburization treatment at the surface of the sintered alloy at temperatures within the solid-liquid co-existing region of the binder phase after sintering or in the process of sintering.

U.S. Pat. No. 4,830,886 discloses a process for forming a coated cemented carbide cutting insert by chemically vapor depositing a layer of titanium carbide under suitable conditions to form a titanium carbide coated insert with eta phase in the cemented carbide substrate adjacent to said titanium carbide coating. Subsequently, the titanium carbide surface is contacted with a carburizing gas for a sufficient time and at a sufficient temperature to convert substantially all of said eta phase to elemental cobalt and tungsten carbide. U.S. Pat. No. 5,665,431 is similar but relates to a titanium carbonitride coating.

WO 99/31292 discloses a body of cemented carbide provided with at least one wear resistant layer, which body contains a zone in the cemented carbide and, adjacent to the applied layer, containing triangular WC platelets with a specific orientation.

WO 98/35071 relates to a method comprising the steps of: a) removing carbon from a surface layer of a cemented carbide substrate at a temperature in the region of about 900° C. to about 1400° C. and in an oxygen-containing atmosphere b) reintroducing carbon into the surface layer of the substrate at a substrate temperature in the region of about 900° C. to about 1400° C. in a carbon-containing atmosphere; and c) coating the substrate with a hard material.

WO 00/31314 describes coated tools and a method of manufacture. The process includes formation of an eta phase-containing surface zone, and a conversion treatment in at least a partial vacuum during which a surface is obtained with microroughness greater than 12 microinches and comprising eta phase and fibrous tungsten carbide grains.

EP-A-0 560 212 describes coated cemented carbide with a Co-enriched surface zone used for cutting tools and having improved resistance to chipping without sacrificing wear resistance. Zr and Hf comprising phases are present within the cemented carbide. The Co enriched surface zone comprises WC grains with increased grain size compared to the inner parts of the cemented carbide.

SUMMARY OF THE INVENTION

In one aspect of the present invention there is provided a method for producing a coated cemented carbide body containing from about 3 to about 12 weight % binder phase with a carbon content below the saturation point with an about 5 to about 100 μm thick surface zone different from the interior of the body comprising decarburizing the cemented carbide body in $H_2$+$H_2O$ or $H_2$+$CO_2$ gas atmosphere at a temperature of from about 900 to about 1290° C., for from about 1 to about 10 h to form an eta phase containing surface zone and then heat treating the body at a temperature of from about 1250 to about 1450° C., for 10 min-10 h, in a neutral gas atmosphere or vacuum to completely retransform the eta phase or other phases formed during decarburization to WC+Co phase.

In another aspect of the present invention there is provided a WC+Co based cemented carbide body, with a carbon content below the saturation point, with or without addition of <about 3 weight % grain growth inhibitors having an average WC grain size of from about 0.3 to about 3 μm containing from about 3 to about 12 weight % binder phase, comprising at least one of the elements Co, Ni, Fe with an about 5 to about 100 μm thick surface zone different from the interior of the body, whereby in the surface zone:

the WC grains have an average grain size at least 20% larger than the nominal WC grain size, together with average Co content at least 10%, higher than the nominal Co content, or the WC grains have an average grain size at least 20% larger than the nominal WC grain size, together with Co content within the range of up to 10% larger and down to 40% lower than nominal content, or the WC grains have an average grain size within the range of +/−20% the same as the nominal average WC grain size, together with an average Co coritent at least 10% higher than the nominal Co content.

In another aspect of the present invention, there is provided a WC+Co based cemented carbide body, with a carbon content below the saturation point with or without addition of <about 3 weight % grain growth inhibitors having an average WC grain size of from about 0.5 to about 1.7 μm containing from about 3 to about 12 weight % binder phase, comprising at least one of the elements Co, Ni, Fe with an about 5 to about 30 μm thick surface zone different from the interior of the body, whereby in the surface zone:

the WC grains have an average grain size more than 30% larger than the nominal WC grain size, together with average Co content at least 30%, higher. than the nominal Co content, or the WC grains have an average grain size more than 30% larger than the nominal WC grain size, together with Co content within the range of up to 10% larger and down to 40% lower than nominal content, or the WC grains have an average grain size within the range of +/−20% the same as the nominal average WC grain size, together with an average Co content at least 30% higher than the nominal Co content.

Figure 1:
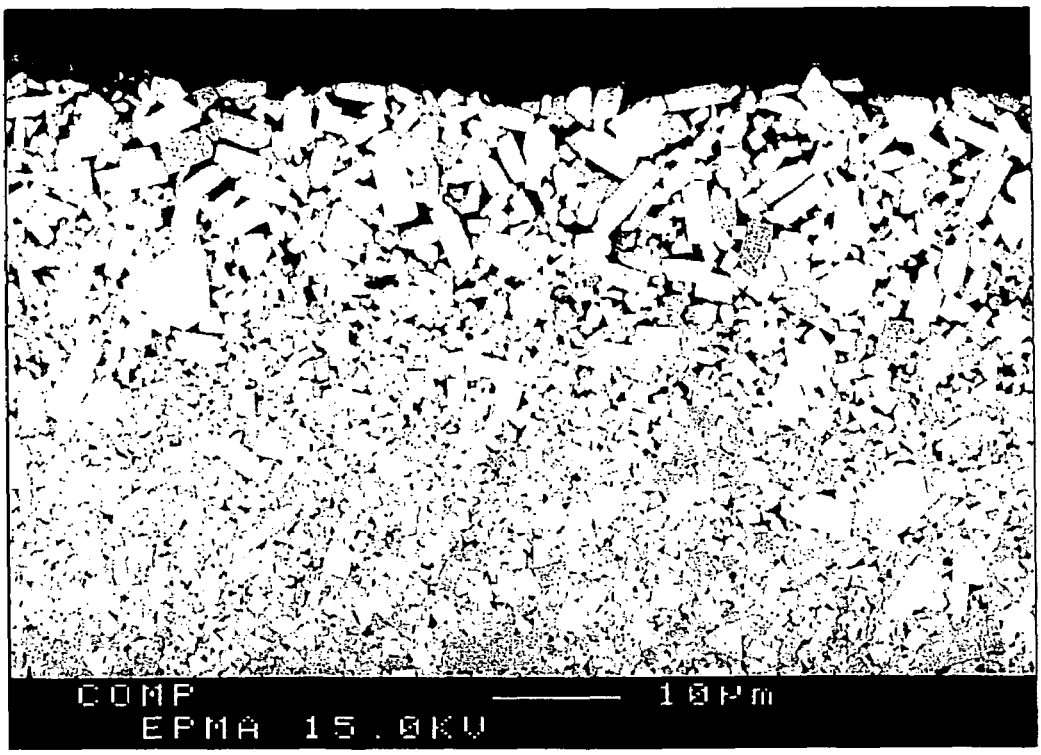
FIGS. 1 to 6 and 9 and 10 show scanning electron micrographs of the surface zone after decarburizing in a decarburizing atmosphere+heat treating in a neutral gas atmosphere.

The images are from the cross-sections of cutting tool inserts.

DETAILED DESCRIPTION OF THE PREFERRED EMBODIMENTS OF THIS INVENTION

It has now surprisingly been found that cemented carbide inserts, first heat-treated in a decarburizing atmosphere at temperatures within the solid region of the binder phase to form an eta phase containing surface zone, then heat-treated in a neutral gas atmosphere, such as Ar, or in a vacuum at temperatures within the liquid region of the binder phase whereby the eta phase in the surface zone is completely retransformed to WC+Co with or without further additional heat treating steps, exhibit improved properties compared to prior art tools with regard to improved tool life due to increased toughness.

In the preferred method of the present invention, cemented carbide bodies are first decarburized by heating them to a temperature from about 900 to about 1290° C. (heat treating step No. 1), preferably from about 1000 to about 1250° C., in a decarburizing atmosphere such as $H_2+H_2O$, or $H_2+CO_2$. The time for the treatment is from about 1 to about 10 h. The degree of decarburization depends on temperature, time and oxygen content in the decarburizing gas, and also on the furnace type. Control of these parameters to achieve the desired decarburization is within the purview of the skilled artisan.

The decarburization treatment results in a surface zone about 100 μm or less thick comprising essentially of eta phase or $W+CO_7W_6$, or W+eta phase or eta phase+WC. (Eta phase is a common name for low carbon containing carbides usually comprising W—Co—C in proportions $M_6C$ or $M_{12}C$ where M=W and Co such as $M_{12}C{=}CO_6W_6C$ and $M_6C{=}CO_3W_3C$, $W_4Co_2C$). In WC—Co-gamma phase grades, the gamma phase will also be present within the decarburized zone besides the eta phase. Other phases which may be found in the surface zone are oxides of the elements present in the cemented carbide bodies. In WC—Co grades, $WO_3$ and $CoWO_4$ phases may also be present in the surface zone.

Decarburization at temperatures between about 950 to about 1050° C. gives a more even thickness of the decarburized zones along the entire surface of the treated bodies whereas decarburization at temperatures from about 1200 to about 1290° C. gives thicker decarburized zones at the edges and corners than on the plane faces of the bodies.

After the decarburization step (heat treating step No. 1), the bodies are heat-treated in a neutral gas atmosphere or vacuum in heat treating step No. 2, to retransform the eta phase or other phases formed during decarburization to a Co enriched WC+Co comprising surface zone. This heat treatment is performed at a temperature from about 1350 to about 1450° C. for from about 10 min to about 10 h, preferably from about 30 min to about 3 h. The selection of suitable temperature and holding time is influenced by the carbon content and degree of decarburization of the heat treated bodies. Bodies subjected to stronger decarburization need longer holding time and/or higher heat treating temperature than bodies subjected to weak decarburization. For bodies with high carbon content close to the saturation point, the heat treating temperature should be selected to within the range of from about 1350 to about 1400° C. and for bodies with low carbon content close to the formation of eta phase the temperature should be within the range from about 1400 to about 1450° C. The heat treating step No. 2 can be performed at one temperature with one holding time, or at more than one temperature and more than one holding time. For example, one part of this heat treatment can be performed at lower temperature such as about 1375° C. with a holding time of about 1.5 h and another part at higher temperature such as about 1450° C. with a holding time of about 3 h.

During heat treating step No. 2, the shape of the WC grains can be unchanged or changed to platelet form. Depending on the degree of decarburization and the selection of the heat treating temperature in step No. 2, there will form WC platelets with or without specific orientation. The formation of the WC platelets is easier in cemented carbide bodies without grain growth inhibitors.

For bodies having an intermediate to low degree of decarburization and with the use of lower temperatures in heat treating step No. 2, a surface monolayer of WC platelets will form oriented perpendicularly to the surface of the body. At intermediate to high temperatures during heat treating step No. 2, there will form WC platelets embedded in the surface zone without specific orientation. In certain embodiments with a high degree of decarburization and high heat treating temperature in heat treating step No. 2, there will form within the surface zone of those certain embodiments, WC platelets with an orientation parallel with the surface of the cemented carbide body. Parallel orientation of the WC platelets is easier formed in bodies with high carbon contents close to saturation point.

If the temperature in the heat treating step No. 2 is selected from about 1250 to about 1340° C., and the bodies subjected to low or intermediate degree of decarburization, there will be formed in certain embodiments a surface comprising WC platelets with increased grain size compared to the nominal WC grain size. The WC platelets will have a specific orientation with the major part of the platelets being oriented perpendicularly to the surface of the body. The major part of the WC grains is present in the form of a surface monolayer of WC platelets. Depending on the selection of the holding time and temperature, the WC platelets can be surrounded by eta phase for a short holding time of from about <0.1 to about 0.5 h or by high Co contents (Co-enrichment) at an intermediate holding time of from about 0.5 to about 2 h, or by very low Co-contents (Co-depletion) at long holding times of from about 2 to about 4 h.

If the formation of the surface with a surface monolayer of WC grains with specific WC-platelets orientation is not desired, the heat treatment should be performed in a neutral gas atmosphere or vacuum at temperatures higher than about 1350° C. (heat treating step No. 2), with a holding time selected so that no eta phase is present after the heat treatment. Such surface zones will in certain embodiments comprise WC grains with increased WC grain size with or without platelet form. The WC grains with increased grain size will be present within the whole surface zone and not only at the surface.

During heat treatment step No. 2, the eta phase is transformed to a WC+Co surface zone with or without increased WC grain size and with Co enrichment, using carbon from the inner parts of cemented carbide bodies. The maximum Co content within the surface zone is obtained just after completed transformation of the eta phase to WC+Co. Prolonged holding time and/or increased heat treating temperature after formation of the WC+Co zone enriched in Co, will result within the surface zone of certain embodiments in decreased Co content. In embodiments with surface zones with increased WC grain size, the Co content after prolonged heat treating holding time/heat treating step No. 2A, and/or additional treatment in increased heat treating temperature/heat treating step No. 2B, both steps in neutral atmosphere will result in Co contents approximately the same, or even lower than the nominal Co content. The heat treating step No. 2B can be performed at more than one heat treating temperature and more than one holding time.

During the holding time after completed transformation of the eta phase to WC+Co, in certain embodiments WC grain growth will occur. Limited WC grain growth occurs also within the rest of the cemented carbide body, but due to higher Co content within the surface zone compared to the rest of the body the WC growth will be much faster within the surface zone than in the rest of the body. The selection of holding time and temperature depends on the degree of decarburization. All eta phase within the surface zone is transformed to WC+Co. The surface zone shall be from about 5 to about 100 μm, preferably from about 5 to about 30 μm, thick.

The body of the present invention is preferably used as a metal cutting tool insert having-planar surfaces intersecting to form cutting tool edges. Such inserts are well known in the art. The thickness of the surface zone at the cutting tool edges is the same as that at the plane surfaces, or it is about <5 times, preferably about <2 times, thicker at the cutting edges. No or only a small difference in thickness is obtained in cemented carbide bodies with weak decarburization at low temperatures or weak to medium decarburization and bodies with increased Co contents more than about 8 weight %. In certain embodiments with thick zones obtained after heavy decarburization, it is suitable to remove the surface zone at the clearance side of the cutting tool and thus obtain cutting tools with equal thickness on the rake face. Another possibility to decrease the thickness of the surface zone at the cutting edges is to perform an edge rounding process of the cutting tool after the heat treating process and not before as usual. In that case, the thickness of the surface zone at the cutting edges will be from about 10% to about 90% of the thickness at the plane surface, or in certain embodiments it can be completely removed at the outermost parts of the cutting edge within about 10 to about 100 μm long distance measured at the cross section of the cutting edge. The difference in thickness of the surface zone at the cutting edges and the plane surfaces is due to larger decarburization of the edges than the plane surfaces obtained due to the decarburizing treatment. In certain embodiments, the surface zone is present only at the cutting edges to a distance of about 1 mm or preferably up to about 0.5 mm from the outermost part of the edge. The surface roughness Ra is about <10 μm, preferably about <5 μm.

The Co-content within the surface zone may be at least about 10% higher, or from about +10% to about −40% of the nominal Co-content. The size and shape of the WC grains may be changed or remain unchanged.

The WC grain size within the surface zone can be increased by at least by about 20%, preferably more than about 30%, or be more or less unchanged compared to the nominal WC grain size within the rest of the body. The increase of the WC grain size takes place mainly in WC—Co bodies without grain growth inhibitors. A larger increase is obtained for cemented carbide grades with a relatively high carbon content close to the saturation point compared to grades with low carbon contents close to the formation of eta phase. Within the surface zones with increased WC grain size, a WC grain size gradient is observed. The grain size increases from the inner parts of the surface zone towards the outer parts of the surface zone. Both types of the surface zones with or without an increase in WC grain size and with Co enrichment are suitable in cutting operations with large demands on toughness.

Surface zones with an increase in the WC grain size or with Co enrichment give increased tool life in cutting operations with large demands on toughness and resistance to deformation at elevated temperatures and chipping resistance.

In bodies obtained after the heat treating steps Nos. 1 and 2, resulting in surface zones with increased WC grain size and increased Co content over the nominal level, it is suitable to reduce the Co content within the surface zone to about the same level as the nominal Co level or even somewhat lower than the nominal level. This is obtained by either prolonging the heat treating holding time of step No. 2—up to about 5 h in neutral atmosphere or vacuum/heat treating step 2A and/or by using an additional heat treatment or treatments, at high heat treating temperatures—up to about 1450° C./heat treating step No. 2B, in a neutral atmosphere or vacuum.

Another possibility to reduce or adjust the Co content is to use after step No. 2 further additional heat treating steps where at least one of heat treating steps is performed in a reducing atmosphere containing a $CH_4$+$H_2$ gas mixture. A reduction in the Co content is obtained in further additional heat treating steps (heat treating steps Nos. 2A, 2B, 3, 4 and 5) after heat treating steps Nos. 1 and 2.

The heat treating step No. 3 is performed in a carburizing atmosphere such as $CH_4$+$H_2$, within the temperature range from about 1200 to about 1370° C. and the time of about 0.1 to about 2 h.

The heat treating step No. 4 is performed in a neutral gas atmosphere or vacuum at temperatures from about 1350 to about 1450° C. and a holding time of from about 0.1 to about 2 h.

The heat treating step No. 5 is performed in a carburizing atmosphere such as $CH_4+H_2$, within the temperature range from about 1200 to about 1370° C. and the time of from about 0.1 to about 2 h.

After heat treating steps Nos. 1, 2, 2A, 2B or 1, 2 and 3, the Co content within the surface zone is reduced to within about ±20% variation of the nominal Co content.

After heat treating steps Nos.1, 2, 2A, 2B or 1, 2, 3 and 4, the Co content within surface zone is adjusted to within about ±10% variation of the nominal Co content.

After heat treating steps 1, 2, 3, 4 and 5, the Co content within surface zone is reduced to from about −20 to about −40% of the nominal Co content.

The difference between using heat treating steps Nos. 1+2, 1+2+2A, 1+2+2B and Nos. 1+2+3, Nos. 1+2+3+4, Nos. 1+2+3+4+5 in reducing Co content in surface zone is that the total carbon content of the bodies will be lower after heat treating in neutral atmosphere step Nos. 2A and 2B than after using carburizing atmosphere steps Nos. 3 and 5.

Bodies according to the invention can be coated with wear resistant coatings using known coating methods.

The method of the present invention can be applied to WC—Co bodies with or without the addition of less than about 3 weight %, preferably less than about 2.5 weight % grain growth inhibitors such as Cr, Ti, Ta, Nb and V, with from about 3 to about 12, preferably from about 5 to about 12, weight % binder phase, with average WC grain size of from about 0.3 to about 3 μm, preferably from about 0.5 to about 1.7 μm, with a carbon content not exceeding carbon saturation. Preferably, no eta phase is present in the bodies prior to the decarburizing treatment. The method of the present invention can also be applied to WC—Co-gamma phase bodies, comprising totally up to about 10 weight % of at least one of following elements Ti, Ta, Nb, Zr, and Hf. The binder phase is preferably Co but it can comprise or be of other elements such as Fe and Ni or mixtures thereof.

In a first preferred embodiment, intermediate to strong decarburization is performed at a temperature from about 1000° C. to about 1250° C. (heat treating step No. 1) with a holding time of from about 2 to about 10 h, in an atmosphere $H_2+H_2O$ with a dew point from about 0° C. to about −30° C., or in a $H_2+CO_2$ atmosphere containing from about 10to about 20% $Co_2$ followed by a heat treatment performed in a neutral gas atmosphere or vacuum from about 1360 to about 1410° C. (heat treating step No. 2) for from about 0.5 to about 5 h.

As a result of the heat treatments Nos. 1 and 2, there is obtained a surface zone with the WC grains having an average grain size about 20% larger, preferably about 30% larger, than the average WC grain size within the cemented carbide body. The surface zone is from about 5 to about 100 μm thick, preferably from about 10 to about 30 μm thick, with an average Co content at least about 10%, preferably about 30%, higher than the nominal Co content.

In bodies with surface zones having increased WC grain size, there may be present an additional intermediate zone between the surface zone and the inner parts of the body. This intermediate zone has about the same thickness or is up to about 200% thicker than the surface zone.and comprises WC phase with grain size from about 10 to about 30% smaller than that within the cemented carbide body. The Co content within this zone may be within about a 10% variation essentially the same as the nominal Co content outside the surface zone or from about 10% to about 30% lower than the nominal Co content. An intermediate zone with decreased WC grain size may be present in cemented carbide bodies with Co contents below about 8 weight %, without grain growth inhibitors and subjected to a strong decarburization treatment. This intermediate zone is absent in bodies with grain growth inhibitors and/or Co contents above about 8 weight %.

Within the surface zone, the shape of the major part of the WC grains is essentially unchanged or partly changed to platelet form. The WC grain size and the amount of the WC platelets increase within the surface zone towards the surface of the body. Grain growth also takes place in WC—Co bodies containing small amounts of weak grain growth inhibitors. However, no WC grain growth is observed in bodies containing VC.

Cemented carbide according to this embodiment is most suitable in cutting operations with large demands on mechanical toughness in cutting operations using heavy interrupted cuts in steel or cast iron without coolant.

The second preferred embodiment is obtained using bodies from the first preferred embodiment being furthermore heat treated in the three additional heat treating steps Nos. 3, 4 and 5. After heat treating steps Nos. 1, 2 and 3, the Co content within the surface zone is adjusted to within about a 20% variation of the nominal Co content. After heat treating steps Nos. 1, 2, 3 and 4, the Co content within the surface zone is adjusted to within about a 10% variation of the nominal Co content and after heat treating steps Nos. 1, 2, 3, 4 and 5, the Co content within the surface zone is adjusted to from about −20 to about −40% of the nominal Co content. The average WC grain size within the surface zone is within about a 10% variation the same or up to about 30% larger as in the first preferred embodiment.

Similar results as obtained after heat treating steps Nos. 3, 4, and 5 with respect to Co content and the WC grain size is obtained after prolonged holding time in step No. 2/in heat treating step No. 2A, at a temperature of from about 1350° C. to about 1450° C., preferably from about 1350 to about 1400° C., and up to about 5 h holding time in a neutral atmosphere or vacuum, or by using heat treating step No. 2B performed at a high heat treating temperature up to about 1450° C. and a holding time from about 1 to about 3 h/in a neutral gas atmosphere or vacuum. The heat treating step No. 2B can be performed at more than one temperature and more than one holding time. If the treatment is performed at two different temperatures, it is suitable that the first heat treating temperature is at least about 20° C., preferably more than about 50° C., lower than the second heat treating temperature.

Cemented carbide according to this last embodiment is most suitable in toughness demanding cutting operations with increased amounts of thermal cycling leading to the creation of thermal cracks and thermally induced flaking, occurring during interrupted cutting of stainless steel with coolant.

The third preferred embodiment is obtained in WC—Co based bodies containing conventional amounts of grain growth inhibitors after weak to intermediate decarburization heat treatment (heat treating step No. 1). The decarburizing treatment is performed either at relatively low temperatures such as from about 950 to about 1000° C., for up to about 10 h in a $H_2+H_2O$ atmosphere with a dew point from about +15 to about +25° C. or at relatively high temperatures such as from about 1250° C. for about 1 to about 2 h and in a $H_2+H_2O$ atmosphere with a dew point from about −20 to about −30° C. Thin surface zones are obtained after such decarburizing treatment with a thickness of up to about 10 μm. The heat treating step in neutral gas atmosphere (heat treating step No. 2) such as Ar or vacuum is performed at from about 1350 to about 1410° C., for about 20 min to about 3 h. The surface zone has a Co content at least about 10%, preferably about 30%, higher than the nominal Co content. The average WC grain size is unchanged or up to about 20% larger than the average WC grain size within the rest of the cemented carbide body. The thickness of the surface zone is from about 5 to about 20 μm, preferably from about 5 to about 10 μm.

Cemented carbide according to this embodiment is most suitable in cutting operations with large demands on toughness using cutting tool inserts with relatively small edge radius.

The invention is additionally illustrated in connection with the following Examples which are to be considered as illustrative of the present invention. It should be understood, however, that the invention is not limited to the specific details of the Examples.

EXAMPLES 1-11

Cemented carbide cutting tool inserts CNMG120412 made in the conventional way were heat treated according to the invention according to Table 1. Table 2 shows the resulting surface zone. The inserts were further coated and tested in cutting tests against untreated inserts with the same coating with results according to Table 2.

TABLE 1

| EX. No. | Cemented carbide composition- | Heat treatment -No. 1 | Heat treatment -No. 2 | Heat treatment -Nos. 3, 4, and 5 |
|---|---|---|---|---|
| 1 | WC + 5.0 w % Co | 1250° C., 4 h, $H_2 + H_2O$ | 1410° C., 1 h, 30 mbar Ar | None |
| 2 | WC + 5.0 w % Co | 1250° C., 4 h, $H_2 + H_2O$ | 1410° C., 1 h, 30 mbar Ar | 1330° C., 0.5 h, $H_2 + CH_4$ |
| 3 | WC + 5.0 w % Co | 1250° C., 4 h, $H_2 + H_2O$ | 1410° C., 1 h, 30 mbar Ar | 1330° C., 0.5 h, $H_2 + CH_4$ + 1410° C., 0.5 h vac + 1330° C., 0.5 h, $H_2 + CH_4$ |
| 4 | WC + 6.0 w % Co | 1250° C., 2 h, $H_2 + H_2O$ | 141.0° C., 1 h, 30 mbar Ar | None |
| 5 | WC + 6.0 w % Co | 980° C., 10 h, $H_2 + H_2O$ | 1390° C., 1 h, 30 mbar Ar | None |
| 6 | WC + 9.5 w % Co, 1.2 w % TaC, 0.3 w % NbC | 1250° C., 4 h, $H_2 + H_2O$ | 1410° C., 1 h, 30 mbar Ar | None |
| 7 | WC + 10.0 w % Co, 0.5 w % Cr3C2 | 1030° C., 8 h, $H_2 + H_2O$ | 1410° C., 1 h, 30 mbar Ar | None |
| 8 | WC + 10.0 w % Co, 0.5 w % Cr3C2 | 1250° C., 6 h, $H_2 + H_2O$ | 1410° C., 2 h, 30 mbar Ar | None |
| 9 | WC + 3.7 w % Co, 1.5 w % TaC, 0.5 w % NbC | 985° C., 5 h, $H_2 + H_2O$ | 1410° C., 1.5 h, vakuum | None |
| 10 | WC + 5.0 w % Co | 1250° C., 4 h, $H_2 + H_2O$ | 1410° C., 1 h, 30 mbar, Ar | 1330° C., 0.5 h, $H_2 + CH_4$ + 1410° C., 0.5 h vac |
| 11 | WC + 5.8 w % Co, 3.5 w % TiC, 2.3 w % TaC 3.5 w % NbC | 1250° C., 4 h, $H_2 + H_2O$ | 1380° C., 2.0 h, Ar | None |

TABLE 2

Figure 2:
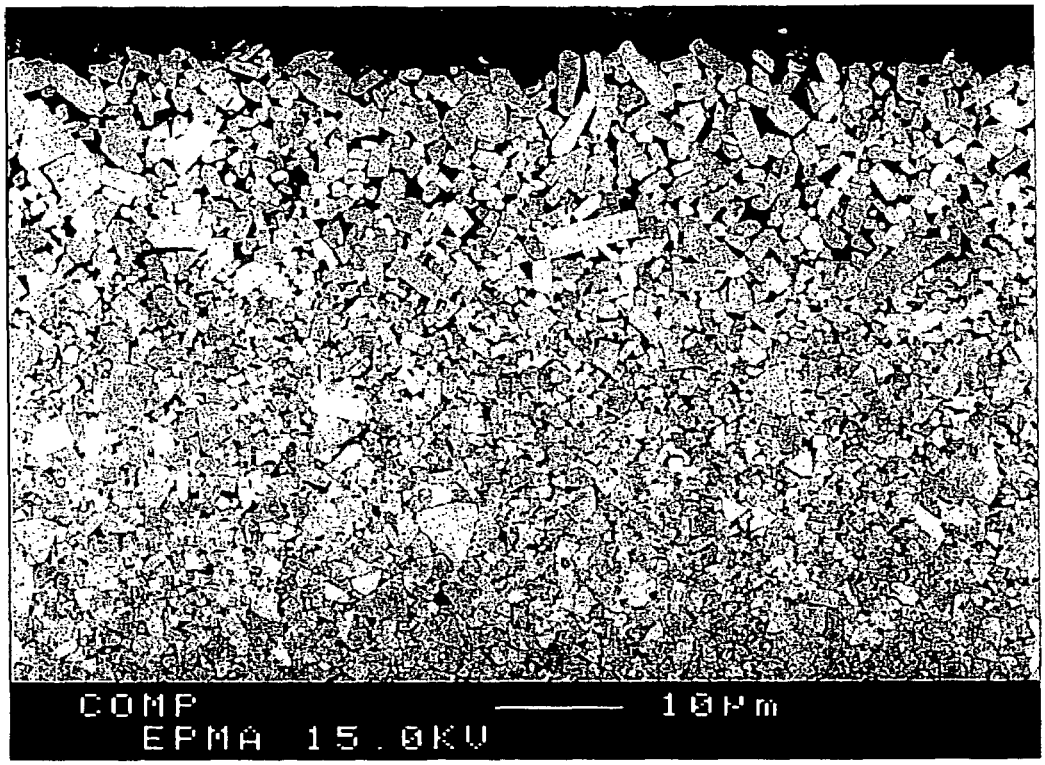
Figure 3:
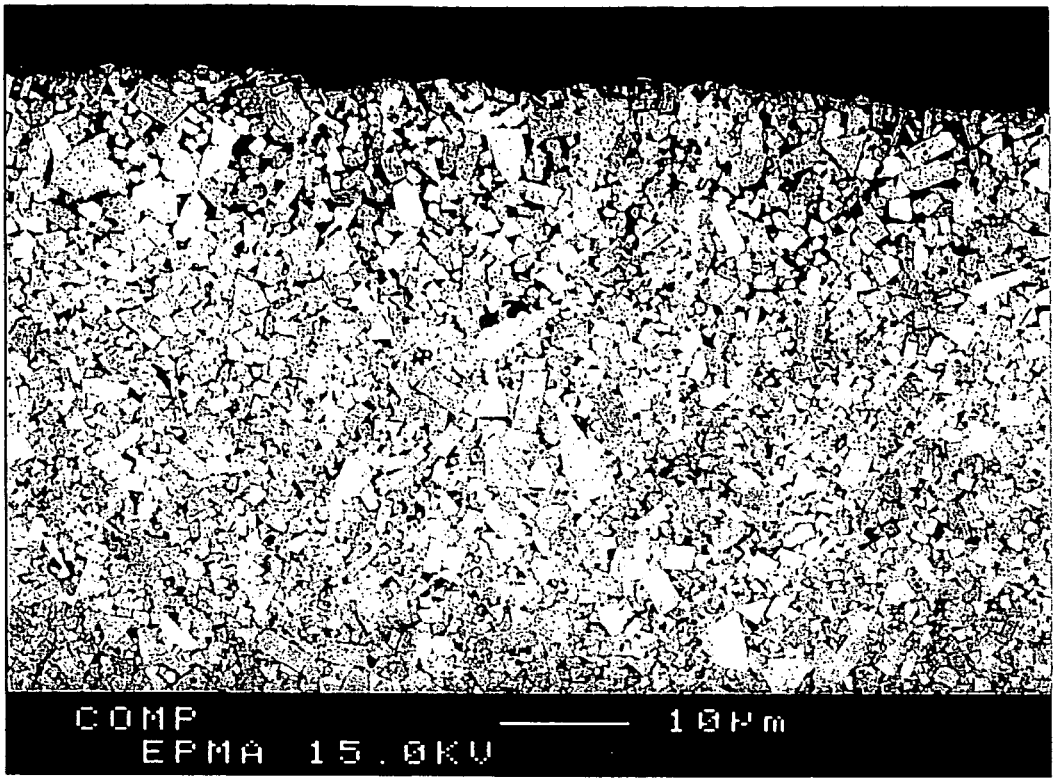
Figure 7:
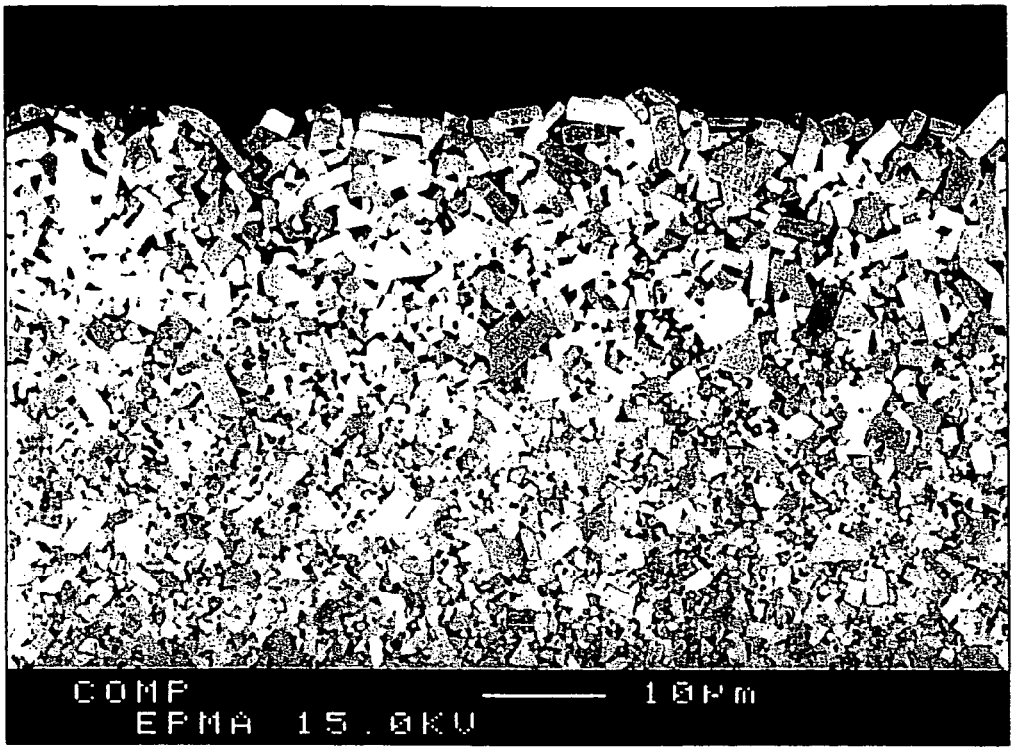
FIG. 7 shows a scanning electron micrograph of the surface zone after decarburizing in a decarburizing atmosphere+heat treating in a neutral gas atmosphere+an additional heat treating in a carburizing atmosphere.
Figure 8:
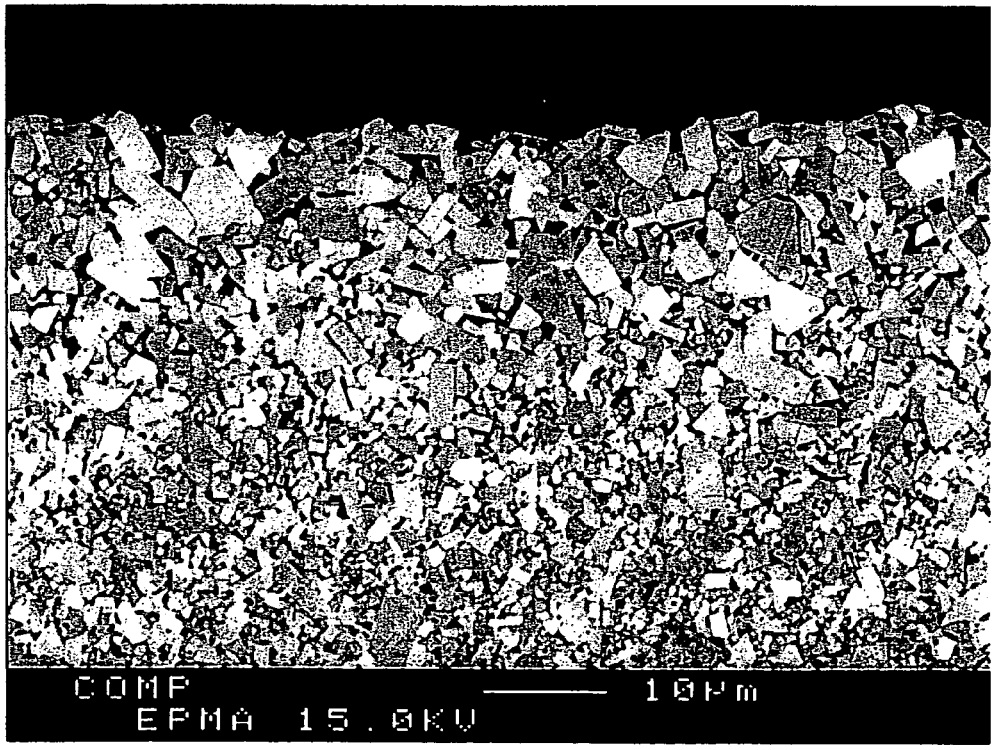
FIG. 8 shows a scanning electron micrograph of the surface zone after decarburizing in a decarburizing atmosphere+heat treating in a neutral gas atmosphere+an additional heat treating in a carburizing atmosphere+another additional heat treating in a neutral gas atmosphere+further another additional heat treating in a carburizing atmosphere.
Figure 9:
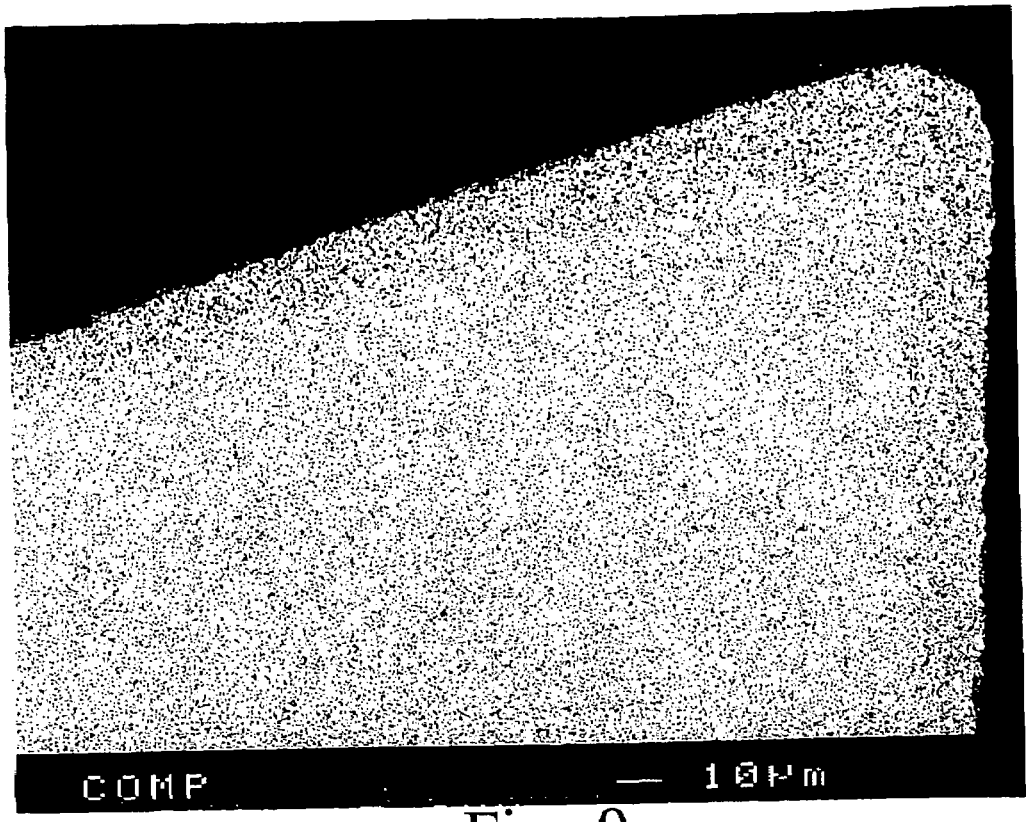
Figure 10:
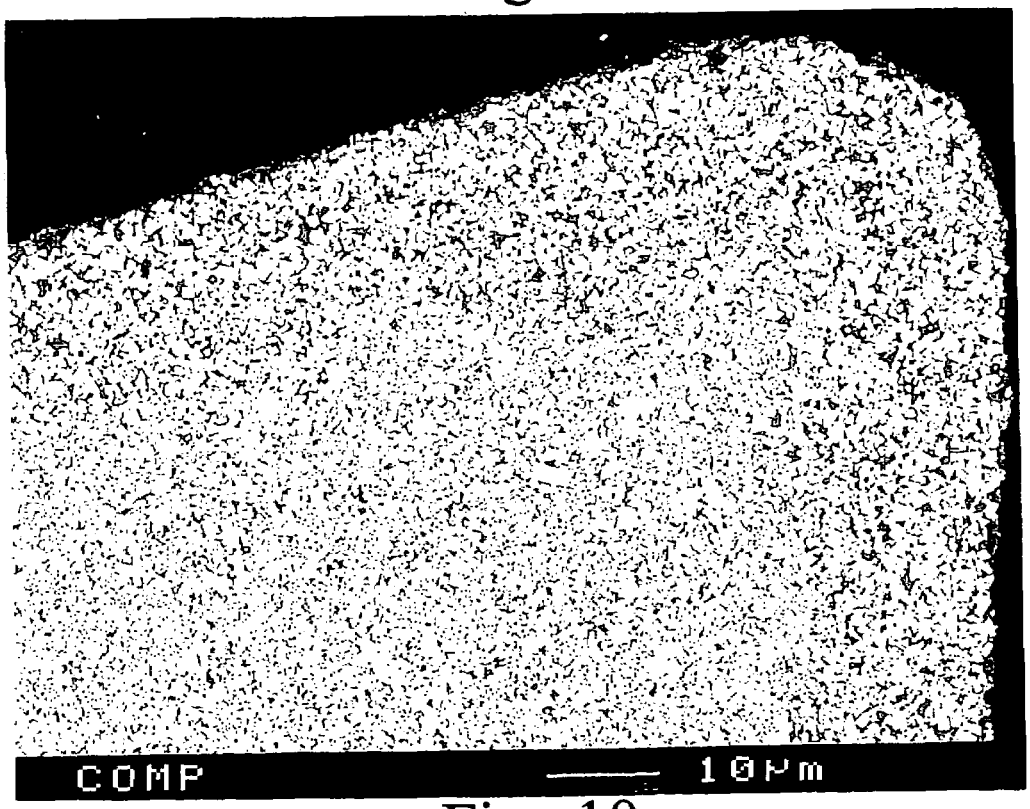

| EXAMPLE No. | Surface zone-thickness, Co-content, WC-grain size + shape | Inside c.c. body, WC-grain size (μm) | Coatings: CVD-MTCVD, PVD | Increase in tool life over Ref. |
|---|---|---|---|---|
| 1A | 18 μm, 8.0 w % Co, 3.2 μm WC, >50% WC-platelets FIG. 1 | 1.5 | 5 μm TiN—TiCN—Ti(C,O) + 5 μm $Al_2O_3$ + 0.5 μm TiN | 30% |
| 1B, REF. | 5.0 w % Co, 1.5 μm WC, <5% WC-platelets | 1.5 | 5 μm TiN—TiCN—Ti(C,O) + 5 μm $Al_2O_3$ + 0.5 μm TiN | |
| 2A | 18 μm, 5.5 w % Co, 3.3 μm WC, >30% WC-platelets FIG. 7 | 1.6 | 5 μm TiN—TiCN—Ti(C,O) + 5 μm $Al_2O_3$ + 0.5 μm TiN | 40% |
| 2B, REF. | 5 w % Co, 1.7 μm WC, <5% WC-platelets | 1.7 | 5 μm TiN—TiCN—Ti(C,O) + 5 μm $Al_2O_3$ + 0.5 μm TiN | |
| 3A | 18 μm, 4.0 w % Co, 3.6 μm WC, >30% WC-platelets FIG. 8 | 1.7 | 5 μm TiN—TiCN—Ti(C,O) + 5 μm $Al_2O_3$ + 0.5 μm TiN | 50% |
| 3B, REF. | 5 w % Co, 1.7 μm WC, <5% WC-platelets | 1.7 | 5 μm TiN—TiCN—Ti(C,O) + 5 μm $Al_2O_3$ + 0.5 μm TiN | |
| 4A | 15 μm, 9.0 w % Co, 2.2 μm WC, 10% WC-platelets, FIG. 2 | 1.5 | 3 μm TiN—TiCN—Ti(C,O) + 3 μm $Al_2O_3$ | 45% |
| 4B, REF. | 6 w % Co, 1.5 μm WC, <5% WC-platelets | 1.5 | 3 μm TiN—TiCN—Ti(C,O) + 3 μm $Al_2O_3$ | |
| 5A | 10 μm 9.0 w % Co, 1.7 μm WC, <5% WC-ptatelets FIG. 3 | 1.6 | 3 μm TiN—TiCN—Ti(C,O) + 5 μm $Al_2O_3$ | 30% |

TABLE 2-continued

Figure 4:
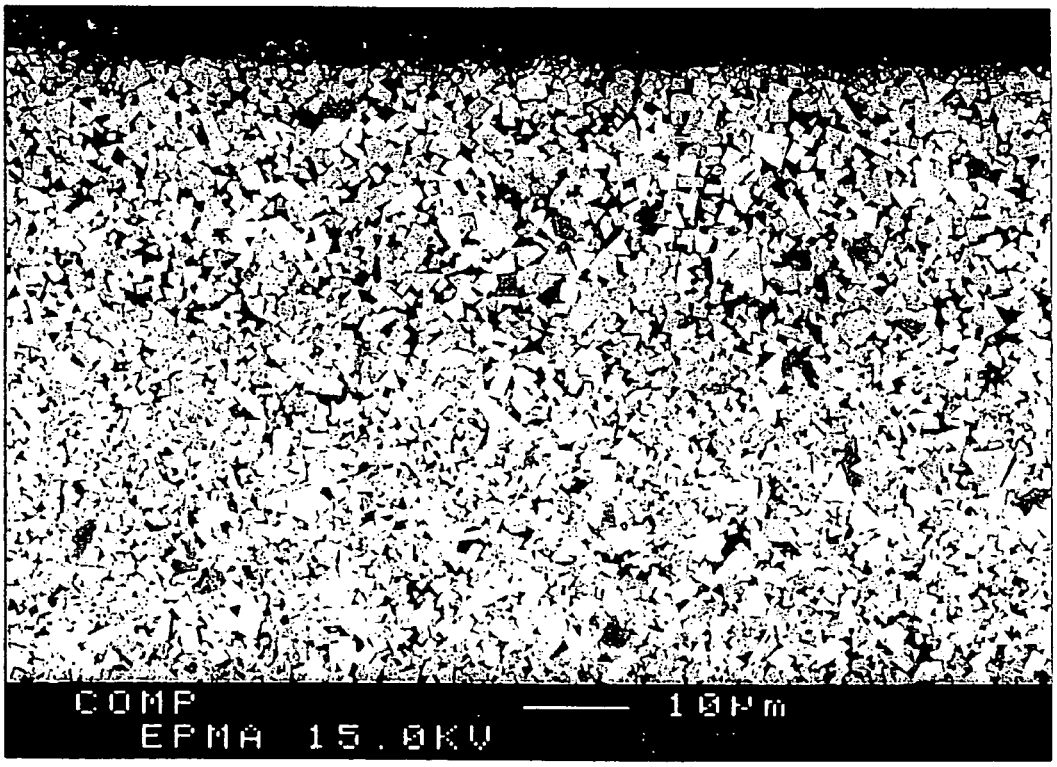
Figure 5:
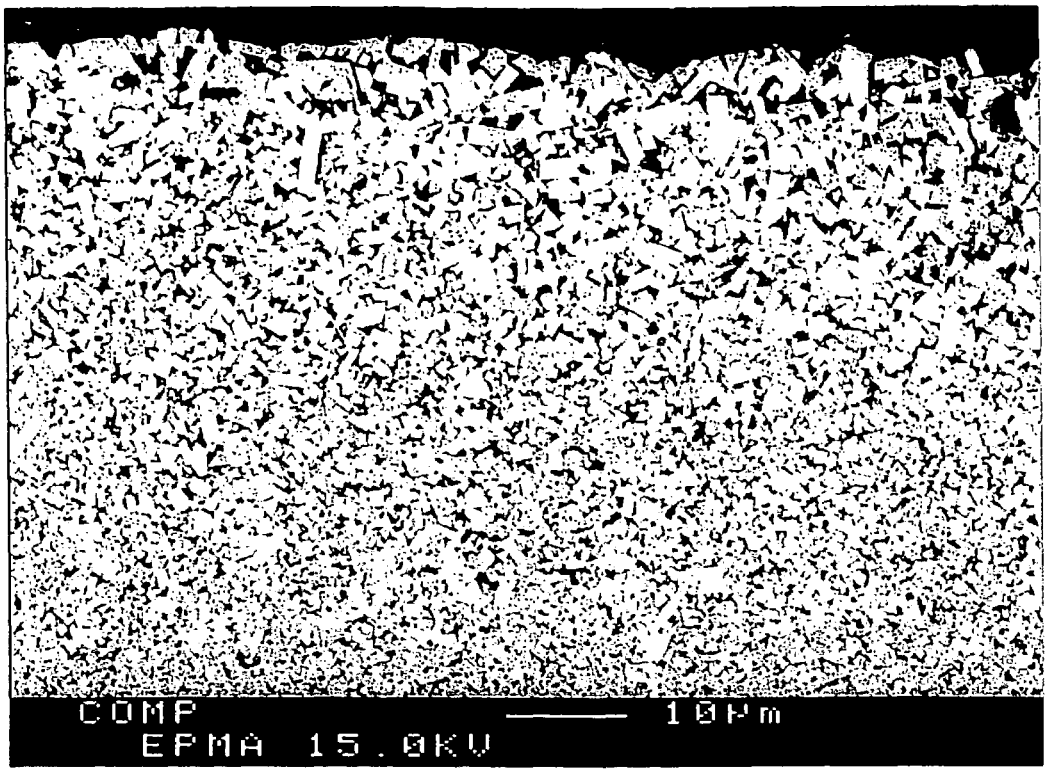
Figure 6:
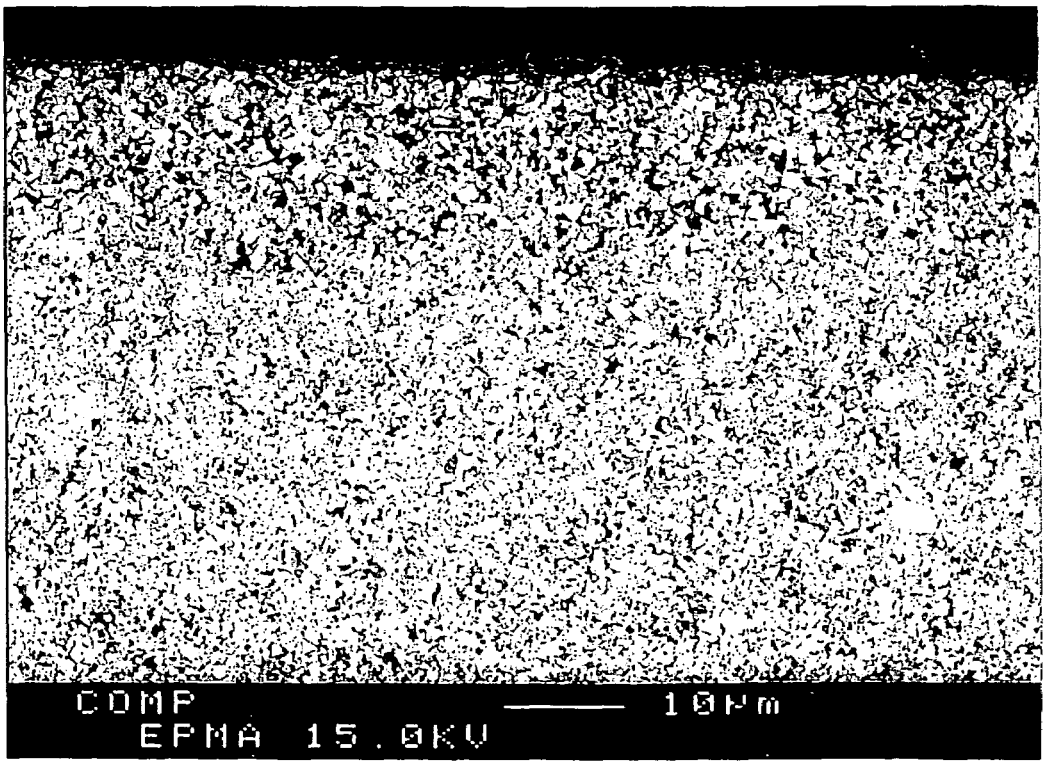

| EXAMPLE No. | Surface zone-thickness, Co-content, WC-grain size + shape | Inside c.c. body, WC-grain size (μm) | Coatings: CVD-MTCVD, PVD | Increase in tool life over Ref. |
|---|---|---|---|---|
| 5B, REF. | 6 w % Co, 1.6 μm WC, <5% WC-platelets | 1.6 | 3 μm TiN—TiCN—Ti(C,O) + 5 μm $Al_2O_3$ | |
| 6A | 25 μm, 14.0 w % Co, 2.2 μm WC, <5% WC-platelets FIG. 4 | 1.9 | 5 μm TiN—TiCN—Ti(C,O) + 5 μm $Al_2O_3$ | 40% |
| 6B, REF. | 9.5 w % Co, 1.9 μm WC, <5% WC-platelets | 1.9 | 5 μm TiN—TiCN—Ti(C,O) + 5 μm $Al_2O_3$ | |
| 7A | 14 μm, 14.0 w % Co, 1.2 μm WC, <5% WC-platelets FIG. 6 | 0.9 | 0.5 μm TiN + 12 × 6 μm TiN, TiAlN multilayer | 55% |
| 7B, REF. | 10 w % Co, 0.9 μm WC, <5% WC-platelets | 0.9 | 0.5 μm TiN + 12 × 6 μm TiN, TiAlN multilayer | |
| 8A | 45 μm, 11–15.0 w % Co, 2.0 μm WC, 5–20% WC-platelets FIG. 5 | 0.9 | 0.5 μm TiN + 6 μm 12 × TiN, TiAlN multilayer | 30% |
| 8B, REF. | 10 w % Co, 0.9 μm WC, <5% WC-platelets | 0.9 | 0.5 μm TiN + 6 μm 12 × TiN, TiAlN multilayer | |
| 9A | 15 μm, 6.0 w % Co, 1.4 μm WC, <5% WC-platelets | 1.2 | 5 μm TiCN + 0.5 μm TiN | 40% |
| 9B, REF. | 3.7 w % Co, 1.2 μm WC, <5% WC-platelets | 1.2 | 5 μm TiCN + 0.5 μm TiN | |
| 10A | 18 μm, 5.0 w % Co, 3.5 μm WC, >30% WC-platelets | 1.7 | 5 μm TiN—TiCN—Ti(C,O) + 5 μm $Al_2O_3$ + 0.5 μm TiN | 45% |
| 10B, REF. | 5 w % Co, 1.7 μm WC, <5% WC plateletes | 1.7 | 5 μm TiN—TiCN—Ti(C,O) + 5 μm $Al_2O_3$ + 0.5 μm TiN | |
| 11A | 14 μm, 9.0 w % Co, 2.9 μm WC, 20% WC-platelets | 2.3 | 0.5 μm TiN + 6 μm 12 × TiN, TiAlN multilayer | 30% |
| 11B, REF. | 5.8 w % Co, 2.3 μm WC, <5% WC-platelets | 2.3 | 0.5 μm TiN + 6 μm 12 × TiN, TiAlN multilayer | |

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

The invention claimed is:

1. WC+Co based cemented carbide body, with a carbon content below the saturation point, with or without addition of <about 3 weight % grain growth inhibitors having a nominal average WC grain size of from about 0.3 to about 3 μm containing from about 3 to about 12 weight % binder phase, comprising at least one of the elements Co, Ni, Fe with about 5 to about 100 μm thick surface zone different from the interior of the body, said surface zone being free of eta phase and wherein within the entire thickness of the surface zone:

the WC grains have an average grain size at least 20% larger than the nominal average WC grain size, together with an average Co content at least 10% higher than a nominal Co content.

2. The WC+Co based cemented carbide body of claim 1 wherein the body also comprises <3 weight % grain growth inhibitors.

3. The WC+Co based cemented carbide body of claim 1 wherein the body also comprises <2.50% grain growth inhibitors.

4. The WC+Co based cemented carbide body of claim 1 wherein the average grain size is from about 0.5 to about 1.7 μm.

5. The WC+Co based cemented carbide body of claim 1 wherein the binder phase comprises Co.

6. The WC+Co based cemented carbide body of claim 1 wherein the surface zone is from about 5 to about 30 μm thick.

7. The WC+Co based cemented carbide body of claim 1, comprising an intermediate zone between the surface zone and the interior of the body, wherein the intermediate zone has a thickness from about 100% up to about 200% the thickness of the surface zone, wherein WC grains in the intermediate zone has an average grain size from about 10 to about 30% smaller than the nominal average WC grain size, and wherein a Co content within the intermediate zone is within the range of ±10% the nominal Co content or is within from about 10% to about 30% lower than the nominal Co content.

8. The WC+Co based cemented carbide body of claim 1, comprising an intermediate zone between the surface zone and the interior of the body, wherein WC grains in the intermediate zone has an average grain size less than the nominal average grain size, wherein the Co content in the cemented carbide body is below about 8 weight % without grain growth inhibitors.

9. WC+Co based cemented carbide body, with a carbon content below the saturation point with addition of <about 3 weight % grain growth inhibitors having a nominal average WC grain size of from about 0.5 to about 1.7 μm containing from about 3 to about 12 weight % binder phase, comprising at least one of the elements Co, Ni, Fe with about 5 to about 30 μm thick surface zone different from the interior of the body, said surface zone being free of eta phase and wherein within the entire thickness of the surface zone:

the WC grains have an average grain size more than 30% larger than the nominal average WC grain size, together with an average Co content at least 30% higher than a nominal Co content.

10. The WC+Co based cemented carbide body of claim 9 wherein a thickness of the surface zone on a cutting edge is greater than a thickness of the surface zone on a plane surface.

11. The WC+Co based cemented carbide body of claim 9 wherein a thickness of the surface zone on a cutting edge is 10% to 90% of a thickness of the surface zone on a plane surface.

12. The WC+Co based cemented carbide body of claim 9 wherein the surface zone is removed at outermost portions of the cutting edge within a distance of 10 to 100 μm measured at a cross section of the cutting edge.

13. The WC+Co based cemented carbide body of claim 9, comprising an intermediate zone between the surface zone and the interior of the body, wherein the intermediate zone has a thickness from about 100% up to about 200% the thickness of the surface zone, wherein WC grains in the intermediate zone has an average grain size from about 10 to about 30% smaller than the nominal average WC grain size, and wherein a Co content within the intermediate zone is within the range of ±10% the nominal Co content or is within from about 10% to about 30% lower than the nominal Co content.

14. The WC+Co based cemented carbide body of claim 9, comprising an intermediate zone between the surface zone and the interior of the body, wherein WC grains in the intermediate zone has an average grain size less than the nominal average grain size, wherein the Co content in the cemented carbide body is below about 8 weight % without grain growth inhibitors.

15. WC+Co based cemented carbide body, with a carbon content below the saturation point, with or without addition of <about 3 weight % grain growth inhibitors having a nominal average WC grain size of from about 0.3 to about 3 μm containing from about 3 to about 12 weight % binder phase, comprising at least one of the elements Co, Ni, Fe with about 5 to about 100 μm thick surface zone different from the interior of the body, said surface zone being free of eta phase and wherein within the entire thickness of the surface zone:

the WC grains have an average grain size at least 20% larger than the nominal average WC grain size, together with an average Co content within the range of up to 10% larger and down to 40% lower than a nominal content.

16. The WC+Co based cemented carbide body of claim 15 wherein the body also comprises <3 weight % grain growth inhibitors.

17. The WC+Co based cemented carbide body of claim 15 wherein the body also comprises <2.50% grain growth inhibitors.

18. The WC+Co based cemented carbide body of claim 15 wherein the average grain size is from about 0.5 to about 1.7 μm.

19. The WC+Co based cemented carbide body of claim 15 wherein the binder phase comprises Co.

20. The WC+Co based cemented carbide body of claim 15 wherein the surface zone is from about 5 to about 30 μm thick.

21. The WC+Co based cemented carbide body of claim 15, comprising an intermediate zone between the surface zone and the interior of the body, wherein the intermediate zone has a thickness from about 100% up to about 200% the thickness of the surface zone, wherein WC grains in the intermediate zone has an average grain size from about 10 to about 30% smaller than the nominal average WC grain size, and wherein a Co content within the intermediate zone is within the range of ±10% the nominal Co content or is within from about 10% to about 30% lower than the nominal Co content.

22. The WC+Co based cemented carbide body of claim 15, comprising an intermediate zone between the surface zone and the interior of the body, wherein WC grains in the intermediate zone has an average grain size less than the nominal average grain size, wherein the Co content in the cemented carbide body is below about 8 weight % without grain growth inhibitors.

23. WC+Co based cemented carbide body, with a carbon content below the saturation point with addition of <about 3 weight % grain growth inhibitors having a nominal average WC grain size of from about 0.5 to about 1.7 μm containing from about 3 to about 12 weight % binder phase, comprising at least one of the elements Co, Ni, Fe with about 5 to about 30 μm thick surface zone different from the interior of the body, said surface zone being free of eta phase and wherein within the entire thickness of the surface zone:

the WC grains have an average grain size more than 30% larger than the nominal average WC grain size, together with an average Co content within the range of up to 10% larger and down to 40% lower than a nominal Co content.

24. The WC+Co based cemented carbide body of claim 23 wherein a thickness of the surface zone on a cutting edge is greater than a thickness of the surface zone on a plane surface.

25. The WC+Co based cemented carbide body of claim 23 wherein a thickness of the surface zone on a cutting edge is 10% to 90% of a thickness of the surface zone on a plane surface.

26. The WC+Co based cemented carbide body of claim 23 wherein the surface zone is removed at outermost portions of the cutting edge within a distance of 10 to 100 μm measured at a cross section of the cutting edge.

27. The WC+Co based cemented carbide body of claim 23, comprising an intermediate zone between the surface zone and the interior of the body, wherein the intermediate zone has a thickness from about 100% up to about 200% the thickness of the surface zone, wherein WC grains in the intermediate zone has an average grain size from about 10 to about 30% smaller than the nominal average WC grain size, and wherein a Co content within the intermediate zone is within the range of ±10% the nominal Co content or is within from about 10% to about 30% lower than the nominal Co content.

28. The WC+Co based cemented carbide body of claim 23, comprising an intermediate zone between the surface zone and the interior of the body, wherein WC grains in the intermediate zone has an average grain size less than the nominal average grain size, wherein the Co content in the cemented carbide body is below about 8 weight % without grain growth inhibitors.

* * * * *